United States Patent [19]

Geberth, Jr.

[11] Patent Number: 4,768,929

[45] Date of Patent: Sep. 6, 1988

[54] HIGH PRESSURE PAINT PUMP

[76] Inventor: John D. Geberth, Jr., 10 Goose Cove La., Ramsey, N.J. 07446

[21] Appl. No.: 85,526

[22] Filed: Aug. 14, 1987

[51] Int. Cl.[4] ..... F04B 41/08; B05B 1/00

[52] U.S. Cl. ..... 417/305; 417/307; 239/590.3

[58] Field of Search ..... 239/590.3; 417/307, 417/305

[56] References Cited

U.S. PATENT DOCUMENTS

| | | | |
|---|---|---|---|
| 2,630,759 | 3/1953 | Mahlon | 417/305 |
| 3,317,141 | 5/1967 | Mann | 239/590.3 X |
| 3,819,303 | 6/1974 | Pfleger | 417/305 |
| 4,527,745 | 7/1985 | Butterfield et al. | 239/590.3 X |
| 4,634,347 | 1/1987 | Gauffin et al. | 417/305 X |
| 4,635,857 | 1/1987 | Hughes | 239/590.3 X |

*Primary Examiner*—Carlton R. Croyle
*Assistant Examiner*—Ted Olds
*Attorney, Agent, or Firm*—Collard, Roe & Galgano

[57] ABSTRACT

A pump system is provided for the pressurization of liquid paint sufficient for hydraulic atomization when the paint is released through the nozzle of a spray gun. The system includes a high pressure pump with an inlet communicating with a source of liquid paint and an outlet, a motor for driving the pump, a pressure controller having a sensing element for sensing and controlling the pressure of the liquid paint delivered by the pump, a filter for filtering the liquid paint delivered by the pump, and a by-pass valve for priming the system on start-up. A multiplex unit is detachably secured to the pressure outlet of the pump and includes a continuous fluid passageway therethrough which begins at the pump outlet and terminates at an outlet port which communicates with a spray gun. The passageway includes the sensing element of the pressure sensor, the filter, and the by-pass valve.

9 Claims, 5 Drawing Sheets

HIGH PRESSURE PAINT PUMP

The present invention relates generally to paint pumps adapted to pump liquid paint to such a pressure that, upon release of the pressurized paint from a spray opening or nozzle in a spray gun, the paint is atomized and thereby rendered suitable for spray painting. More particularly, the present invention relates to an improved high pressure paint pump wherein the parts are arranged and components assembled so as to provide maximum accessibility, reliability, and compactness of the pump and the various parts thereof.

In hydraulic paint spraying, a pump is utilized to pressurize the paint to pressures of about 2,000 pounds per square inch so that the paint can be atomized upon release from a nozzle. Such pumps are normally relatively heavy and cumbersome, yet they must be carried by the operators thereof from one job location to other job locations as needed and continually repositioned during utilization as the painting operations progress. Therefore, operators of such hydraulic paint spraying equipment, which by and large are professional painting contractors or employees thereof, must expend a great deal of energy and time in moving such heavy and unwieldy equipment about a job site and from site to site. Obviously, a lighter and more compact piece of equipment with performance characteristics equivalent to those of pumps presently available on the market would certainly be well received amongst those who must utilize such equipment on a daily basis.

In such prior art pump systems for hydraulic paint spraying, the pressurized paint upon leaving the pumping mechanism is directed to several separate additional components which, for example, sense and control the pressure of the paint, filter the pressurized paint and prime the system at time of start-up. The pressure controller insures the delivery of the paint at the proper pressure while the filter removes impurities and particles from the paint so as to prevent clogging of the nozzle opening of the spray gun. The priming means is provided for priming the pump on initial start-up and consists of a by-pass valve disposed between the spray gun and the pump filter. Such additional components are added onto the basic high pressure pump by the manufacturer and significantly increase the weight and size of the pump system.

It is, therefore, a primary object of the present invention to provide a paint pump for pressurizing paint so that the paint can be atomized and sprayed onto a surface by means of a spray gun wherein the parts and components of the pump are arranged and assembled to provide maximum accessibility and reliability of the various component parts and compactness of the pump system.

The above object, as well as others which will hereinafter become apparent, is accomplished in accordance with the present invention by a high pressure paint pump system wherein the above operations performed on the pressurized paint are taken into consideration in the arrangement of passageways and ports within a multiplex unit connected through a manifold coupling directly to the pump unit high pressure outlet which results in a compactness of design and savings of material utilized in the manufacture of the system. Thus, subsequent to pressurization by the pumping mechanism, the pressurized liquid paint is directed from the pump outlet into a series of passageways in a block shaped multiplex unit which are so arranged that the pressure controller and the filter can be attached to the unit and the by-pass valve included therein so as to significantly increase the reliability and compactness of the system. In addition, by arranging the by-pass valve between the filter and the pump outlet, when it is time to cease the painting operation and "dump" or drain the paint from the spray gun and hose, the filter is subject to a back flow of paint which substantially cleans the filter thereby increasing its effective life.

Because of the optimal arrangement of passageways and the optimal assembly of the pressure controller, filter and dump valve components in this multiplex unit connected directly to the pump outlet, there results a pump system having maximum reliability and compactness and wherein the accessibility of these various additional components is maximized.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
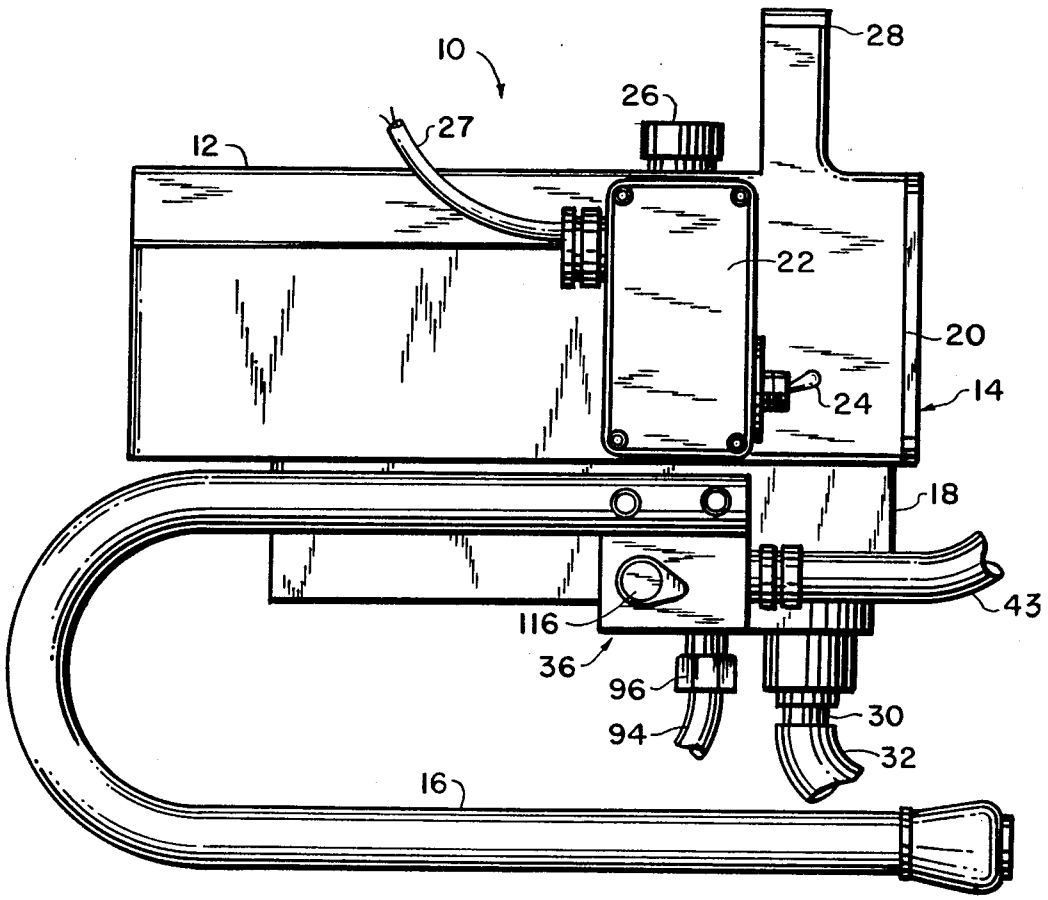
FIG. 1 is a side elevational view of the pump system according to the present invention.

Now turning to the drawings, there is shown in FIG. 1 a high pressure pump system for pressurizing liquid paint, generally designated 10, comprising a motor section, designated 12, and a pump section, designated 14, supported by support legs 16. Motor section 12 houses an electrically powered motor (not shown) whose drive shaft drives the pump, designated 18, through a reduction gear box and crank shaft housed in gear box housing 20 of pump section 14. A motor controller, designated 22, controls the operation of the motor through on/off switch 24 and pressure controller 26. Power is supplied to the electrical motor through motor controller 22 via electrical wire 27. A handle, designated 28, is provded at the top of pump section 14, which permits the easy lifting and carrying of pump system 10 by an operator.

Pump 18, which is the subject of my earlier filed application entitled "HYDRAULIC PAINT PUMP", Ser. No. 890,752, filed July 25, 1986, the disclosure of which is incorporated herein by reference, includes a piston which is connected to the crank shaft of the gear box through a slider mechanism which is connected to the connecting rod of the crank. Thus, pump 18 can be easily and quickly detached from pump system 10 by merely removing the bolts securing the housing of pump 18 to pump section 14, disconnecting it from the other elements of pump system 10 and sliding pump 18 forward with respect to pump system 10 to disengage the piston from the slider mechanism. The inlet 30 to pump 18 has connected to it a flexible hose 32 which is connected to a supply of paint. The outlet (not shown)

of pump 18 communicates directly with a port 34 (see FIG. 3) in multiplex unit 36 which in turn ultimately communicates with outlet port 38 of the multiplex unit. A flexible hose 40 which communicates with a spray gun (not shown) is connected to outlet port 38 of the multiplex unit and delivers the pressurized paint to the spray gun.

Figure 2:
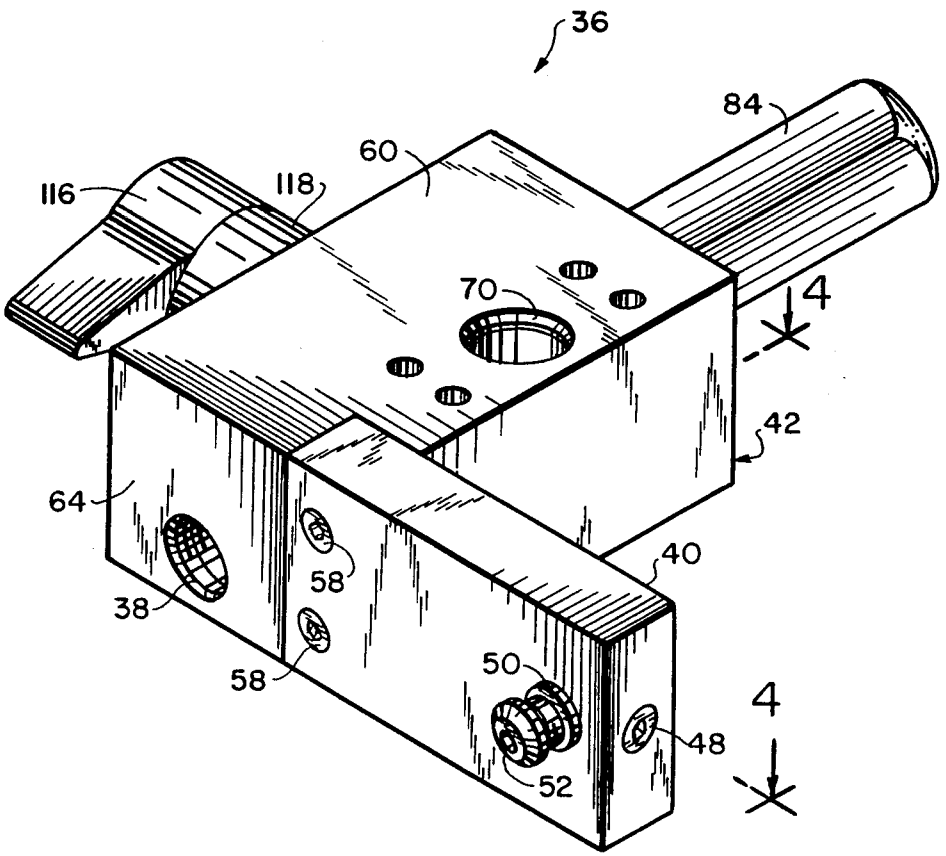
FIG. 2 is a perspective view of the multiplex unit attached to the pump mechanism outlet.
Figure 3:
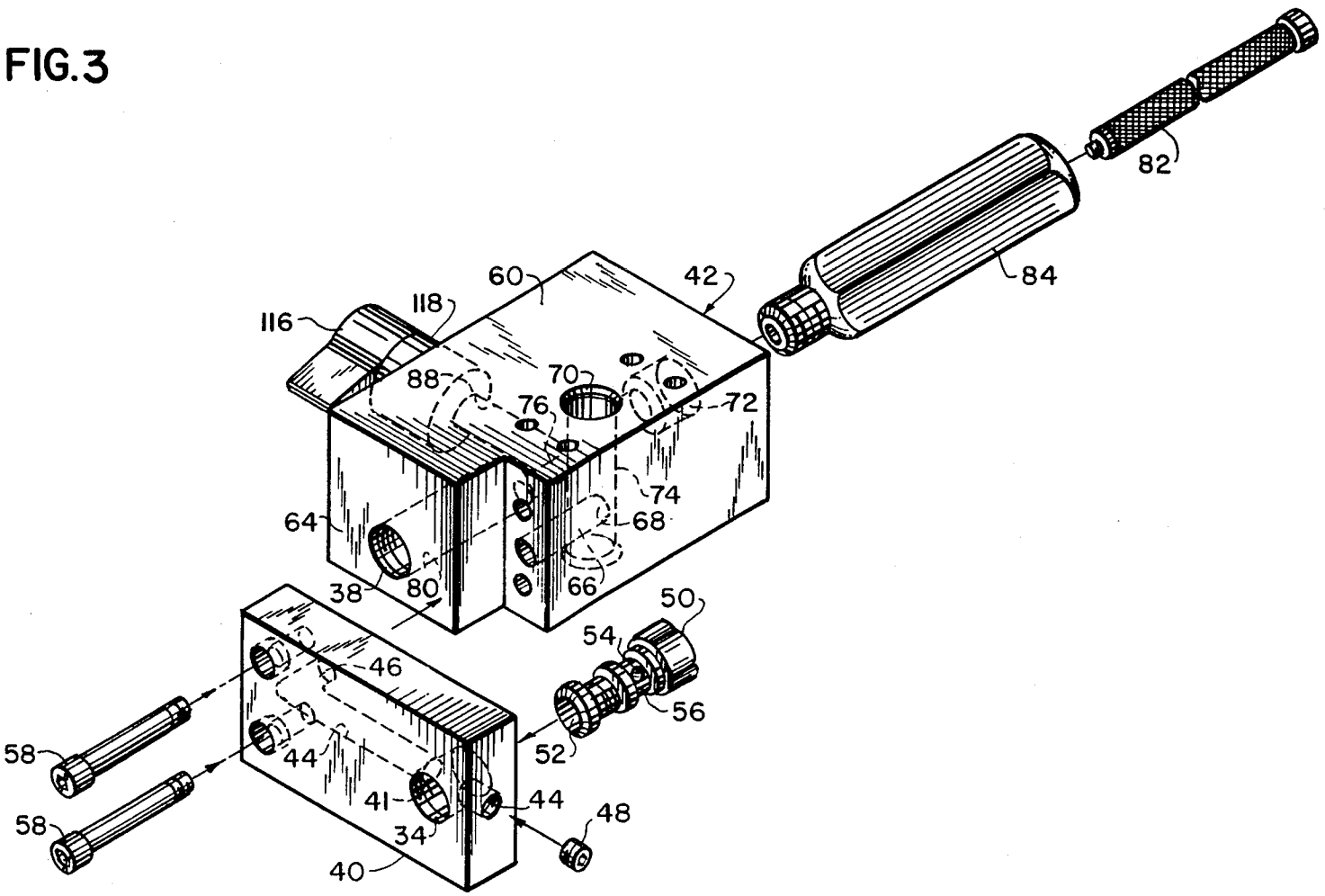
FIG. 3 is an exploded view of the multiplex unit of FIG. 2.
Figure 4:
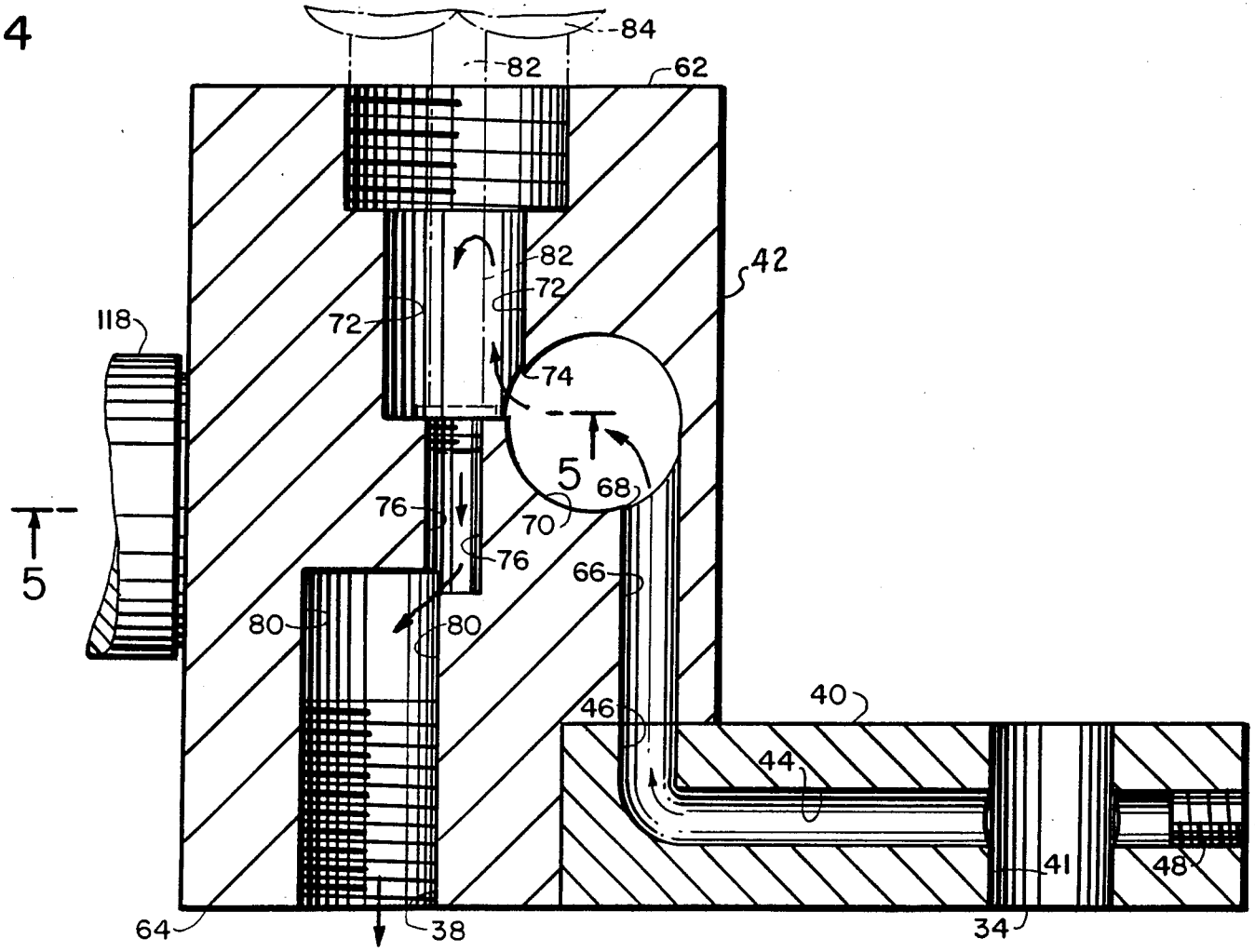
FIG. 4 is a horizontal cross-sectional view of the multiplex unit of FIG. 2 taken along the line 4—4 of FIG. 2.

As clearly seen in FIGS. 2 to 4, multiplex unit 36 is basically comprised of a manifold coupling, designated 40, and a multiplex block, designated 42. Manifold coupling 40 has a through bore 41 originating at port 34 which communicates with the outlet of pump 18 and a substantially horizontal bore 44 at right angles to and intersecting bore 41. Bore 44 extends substantially the length of manifold coupling 40 towards the connection thereof with multiplex block 42. A bore 46, parallel to bore 41, is cross drilled in manifold coupling 40 to intersect bore 44 from the face of coupling 40 opposite the face thereof including port 34. Thus, a continuous passageway having a substantially S shape between port 34 and the outlet of bore 46 results. The open end of bore 44 is closed by means of cap screw 48. A banjo bolt, designated 50, secures coupling block 40 to pump 18 by passing through bore 41 and port 34 and threadably engaging with the outlet of pump 18. Because of the longitudinal center bore 52 in bolt 50, which is intersected by cross bore 54 in undercut 56, the pressurized paint is transferred from the pressure outlet of pump 18 to bores 44 and 46 of coupling block 40.

The face side of manifold coupling 40 at bore 46 is secured by screws 58 to multiplex block 42. Multiplex block 42 has several distinct face sides at which different functions are performed. The top side face of block 42 is the pressure measuring face 60 while the back side face of block 42 is the filter face 62 and the front side face adjacent to which manifold coupling 40 is secured is the outlet face 64 of the block. Thus, bore 46 of manifold coupling 40 is aligned with longitudinal bore 66 in multiplex block 42 which is adjacent to outlet face 64 thereof. Bore 66 terminates at its intersection 68 with pressure sensor receiving well 70 formed in the pressure measuring face 60 of block 42. Well 70 is adapted to accept therein the pressure sensor of pressure controller 26 when multiplex unit 36 is arranged on pump system 10. A well-like bore 72 is formed in the filter face 62 of block 42 perpendicular to and offset sideways from well 70 such that its intersection 74 therewith is a small segment of both. Bore 72 terminates at intersection 74 and a coaxial extension 76 of bore 72 terminates at its intersection 78 with bore 80 which originates at outlet face 64 with outlet port 38 of multiplex block 42. A filter cartridge, designated 82, extends into bore 72 and is threadably engaged with bore 76. Filter casing 84 surrounds filter 82 and is threadably engaged with bore 72.

The flow of paint through multiplex unit 36 is clearly shown in FIG. 4 wherein the pressurized fluid is delivered from pump 18 to banjo bolt 50 from which it enters bore 44 of manifold coupling 40 and is directed through bore 46 to bore 66 of multiplex block 42. From bore 66 the pressurized paint enters well 70 where the pressure of the paint is sensed by the pressure sensor of pressure controller 26 which adjusts the speed of the motor for pump 18 as necessary to achieve the pressure setting of the pressure controller. The pressurized paint then passes through intersection 74 into well 72 and filter casing 84. The pressurized fluid is filtered through filter cartridge 82 and enters bore 76 to pass through intersection 78 into bore 80 to exit at outlet port 38. A flexible hose 43, through which the pressurized paint is directed to the spray gun, is connected to outlet port 38 of multiplex block 42, as clearly seen in FIG. 1.

Figure 5:
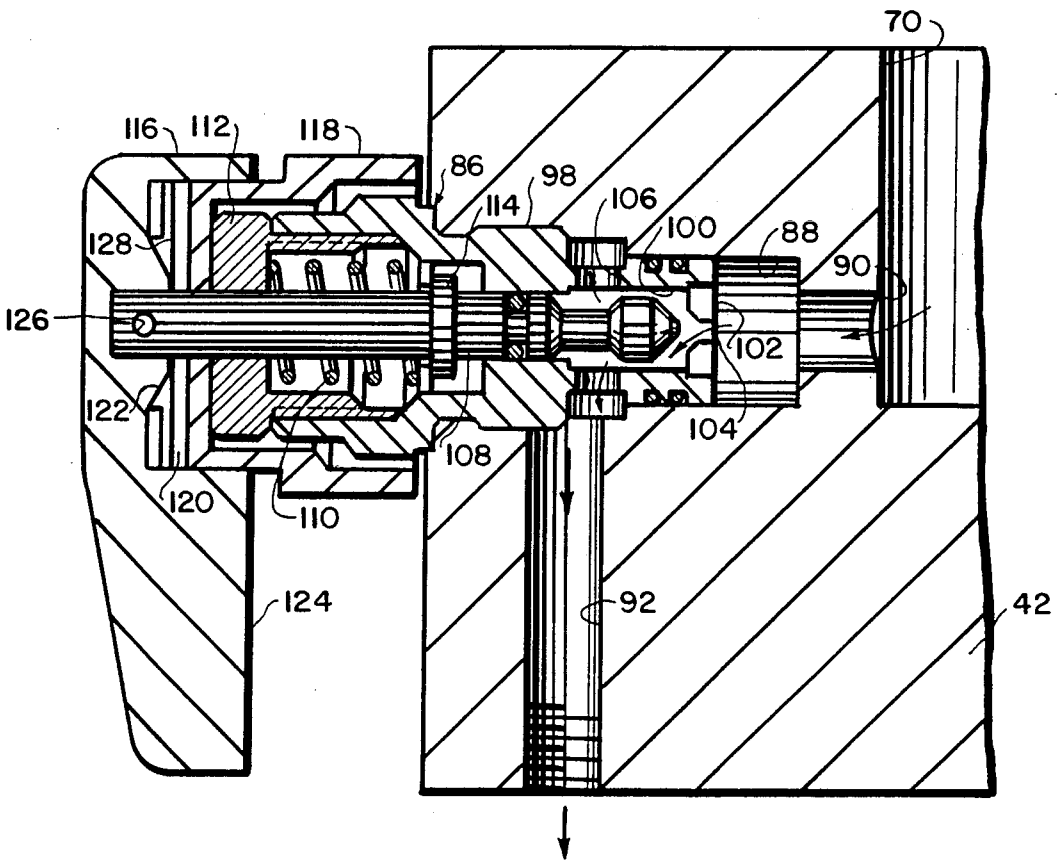
FIG. 5 is a vertical cross-sectional view of the multiplex unit taken along line 5-5 of FIG. 4 showing the dump valve.

The dump valve or by-pass valve, generally designated 86, is clearly shown in FIG. 5 by means of a vertical cross section of multiplex block 42. By-pass valve 86 is arranged in a by-pass bore 88 which terminates at pressure sensor receiving well 70 at intersection 90 thereof. Bore 88 is disposed at a lower horizontal level than bores 72, 76 and 80 so that no intersection therewith occurs. By-pass valve 86 is adapted to divert the pressurized fluid from pressure sensor receiving well 70 into by-pass bore 88 and through discharge bore 92 when activated. Upon being discharged through bore 92, the diverted fluid paint enters a hose 94 through fitting 96 (see FIG. 1) and is thereby directed to the source of fluid paint or some other receptacle for the dumped fluid paint. By-pass valve 86 consists of a valve housing 98 threadably received in by-pass bore 88 having a throughbore 100 extending longitudinally therethrough with a valve seat 102 defining a valve opening 104 at the forward end thereof. Cross bore 106 is provided in housing 98 at the intersection with discharge bore 92. Thus, with the sealing engagement between housing 98 and the side wall of bore 88, fluid can only enter through valve opening 104 when it is open and pass through cross bore 106 into discharge bore 92.

To clear or open valve opening 104, valve stem 108 is longitudinally movable in bore 100 of housing 98 from its seated position on valve seat 102 against valve opening 104. Spring 110, retained by retainer 112 which is internally threadably engaged with housing 98, biases valve stem 108 to its seated position by exerting a closing force on valve stem 108 by engagement with shoulder 114 of valve stem 108. Spring 110 also serves as a safety spring so that if the pressure of the fluid in the fluid system exceeds a predetermined pressure corresponding to the spring force of spring 110, the spring pressure will be overcome and valve stem 108 unseated from valve seat 102 so that the pressurized fluid exits through discharge bore 92.

In order to operate valve 86 and retract valve stem 108 from engagement with valve seat 102, an operating means 116 is provided. Operating means 116 consists of a stationary cap 118 which fits over valve stem retainer 112 at the end of valve housing 98. The upper end of cap 118 has a cam surface 120 which engages with cam surface 122 of operating handle 124. Operating handle 124 is fixedly secured to the outer end of valve stem 108 by means of cross-pin 126 which passes through both operating handle 124 and the outer end of valve stem 108. Thus, when it is desired to retract valve stem 108, operating handle 124 is rotated with respect to cap 118 so that the engaging cam surfaces 120 and 122 cam against one another, thereby raising cam surface 122 of operating handle 124 against the force of spring 110 onto bridge 128 of cam surface 120. This permits the fluid from pressure sensor receiving well 70 to be diverted through valve opening 104 and into bore 100 of valve housing 98 through bores 106 and into discharge bore 92, thereby by-passing the remainder of the system which includes the filter cartridge 82 and outlet 38 to the spray gun. Since by-pass valve 86 is positioned upstream from filter cartridge 82, the filter is effectively backwashed when valve 86 is operated and the system drained. This backwashing cccurs because the pressure in flexible hose 40 leading to the spray gun has caused the hose to expand so that when the dumping operation occurs through valve 86, hose 43 relaxes causing the excess paint therein to be forced under pressure backwards through the system and out discharge bore 92. During this course of action, it can be seen that the high pressure fluid passing backwards through filter cartridge 82 removes the particles trapped on the outside thereof and flushes them out the discharge bore 92.

While only a single embodiment of the present invention has been shown and described, it will be obvious that many changes and modifications may be made thereunto without departing from the spirit and scope of the invention.

What is claimed is:

1. In a pump system, particularly for the pressurization of liquid paint sufficient for hydraulic atomization when said paint is released through the nozzle of a spray gun, having a high pressure pump with an inlet communicating with a source of liquid paint and an outlet, motor means for driving said pump, a pressure controller having a sensing element for sensing and controlling the pressure of the liquid paint delivered by said pump, a filter for filtering the liquid paint delivered by said pump, and a by-pass valve for priming said system on start-up, the improvement comprising:

a substantially cube shaped multiplex unit detachably secured to said pump at the pressure outlet thereof, said multiplex unit having a first well-like opening in a first face thereof for accepting the pressure sensor of said pressure controller, a second well-like opening in a second face normal to said first face for said filter, and an outlet port in a third face communicating with a spray gun; and a continuous fluid passageway in said multiplex unit commencing at the pressure outlet of the pump and terminating at the outlet port of the multiplex unit, said continuous passageway comprising, a first fluid bore connecting the pressure outlet of the pump to said first well-like opening, said second well-like opening peripherally intersecting said first well-like opening at a right angle thereto such that the center line of said second well-like opening does not intersect said first well-like opening, and a second fluid bore coaxial with said second well-like opening and communicating with said outlet port.

2. The pump system as defined in claim 1, wherein said outlet port of the multiplex unit is in a third face of said cube shaped unit opposite said second face thereof.

3. The pump system as defined in claim 2, wherein said fluid passageway commences at said third face of said cube shaped unit.

4. The pump system as defined in claim 1, which further includes a manifold coupling disposed between said multiplex unit and the pressure outlet of said pump, said manifold coupling being detachably secured to said pump and said multiplex unit.

5. The pump system as defined in claim 4, wherein said manifold coupling is disposed to extend substantially at a right angle to said multiplex unit so that the said multiplex unit is off-set from the pressure outlet of the pump.

6. The pump system as defined in claim 1, wherein the by-pass valve is disposed in the fluid passageway of said multiplex unit upstream from said filter.

7. The pump system as defined in claim 6, wherein said by-pass valve includes a by-pass bore which intersects said first well-like opening for the sensing element, a valve opening in said by-pass bore, a valve stem normally biased to close said valve opening, and means for moving said valve stem against said bias to open said valve.

8. The pump system as defined in claim 7, wherein said normally biased valve stem includes a pressure operated safety spring.

9. The pump system as defined in claim 1, wherein said filter is a filter cartridge removably inserted into the coaxial bore of said well-like opening so as to filter the fluid paint passing through said passageway, said filter extending from said second well-like opening and having a housing therefor threadably engaged with said opening.

* * * * *